United States Patent [19]

Kapples

[11] 3,972,453

[45] Aug. 3, 1976

[54] COMBINED CLOSURE AND POURING DEVICE

[76] Inventor: Lawrence J. Kapples, 502 Lenox Ave., Pittsburgh, Pa. 15221

[22] Filed: June 20, 1975

[21] Appl. No.: 588,686

[52] U.S. Cl. ..... 222/530; 222/570

[51] Int. Cl.[2] ..... B67D 5/37

[58] Field of Search ..... 222/569, 570, 538, 566, 222/567, 563, 529, 530; 141/319, 320

[56] References Cited

UNITED STATES PATENTS

| | | | |
|---|---|---|---|
| 2,413,438 | 12/1946 | Doose | 222/539 |
| 2,736,469 | 2/1956 | Stone | 222/529 |
| 3,021,037 | 2/1962 | Parker | 222/570 X |
| 3,372,832 | 3/1968 | Yeater et al. | 222/570 X |
| 3,620,267 | 11/1971 | Seablom | 141/319 |

*Primary Examiner*—Stanley H. Tollberg
*Attorney, Agent, or Firm*—Robert D. Yeager; Howard G. Massung

[57] ABSTRACT

A closure device for a container comprising a closure member adapted to close the opening of a container and through which is provided an opening, smaller than the container opening, which allows the outflow of material from within the container, a lid member adapted to close the opening in the closure member, and a spout extending from a peripheral portion of the closure member which is adapted to controllably conduct away from the container material flowing through the opening in the closure member and out of the container.

In another embodiment of the invention a container with a top having a preformed access opening is provided with a spouted closure device. The closure device comprises a closure member through which is provided a similar preformed access opening, a lip which provides fluid-tight contact with the top of the container, and a spout extending from a peripheral portion of the closure member. The spout is adapted to controllably conduct away from the container material flowing through the access openings of the closure member and the top of the container when the closure device is oriented spout-up, with the access openings aligned, on the container and is further adapted to avoid physical interference with adjacent apparatus when the closure device is oriented spout-down.

30 Claims, 24 Drawing Figures

COMBINED CLOSURE AND POURING DEVICE

BACKGROUND OF THE INVENTION

1. Field of the Invention

This invention relates to closure devices for containers and more particularly to a combined closure and pouring device having a closable opening therein and an integral spout enabling controlled pouring of material directly from the container.

2. Description of the Prior Art

Closures for containers are found in the prior art in as many forms and shapes as there are forms and shapes of containers. Likewise, the functions of such closures vary from closures alone to closures plus other functions in combination such as discharge by a spout or a scoop. U.S. Pat. Nos. 2,347,253 and 3,085,710 disclose two forms of closures into which a type of spout is incorporated so that liquids within the containers may be poured directly from the containers. U.S. Pat. No. 3,380,307 discloses a closure which is deformable into a scoop. In addition there are disclosed in the prior art various devices which enable material to be poured directly from a container but which do not function as closures. U.S. Pat. Nos. 280,515, 1,165,285 and 3,726,447 show devices which function as spouts independent of any particular closure device and U.S. Pat. Nos. 2,075,721 and 3,021,977 show devices which allow consumption of liquids directly from a container but which do not function as closure devices.

It is desirable in a closure for a container to provide for other functions in addition to closure alone, such as a pouring function by means of a spout. It is further desirable that structural features providing such functions be positionable in both a functional position and a storing position. For example, in a closure which incorporates a spout, it is desirable that the spout be positionable to allow for pouring and alternatively to allow for storing, stacking or shipping of the container without physical interference with the spout. The closure disclosed in U.S. Pat. No. 3,085,710 is configured so that the spout is positionable only in one position — a functional position allowing for pouring from the container. Stacking, storing and shipping a container with such a closure would be impractical because the spout would interfere with efficient stacking of such containers.

It is further desirable that such a closure be able to close the opening of the container whether or not the structural features providing other functions be positioned in functional or storing positions. For example, the closure disclosed in U.S. Pat. No. 2,347,253 is constructed so that when the spout is positioned for pouring, the closure no longer functions to close the container. The closure must be reversed so that the spout is placed in the storing position before the closure in fact closes the opening of the container. While such a result is of little practical significance when a container is being stored or shipped by a manufacturer, it is of great significance once a container has reached the consumer. At that time, the feature of being able to position the spout in a storing position becomes less important. What then becomes more desirable is that the container be closable even if the spout remains in a pouring position.

The desirability of the feature just described can be illustrated by reference to a closure which incorporates a spout and which is adapted to close a typical 1 gallon paint container. After pouring the desired quantity of paint from the container, it is readily apparent that reversing the closure in order to close the container would create more spillage than pouring from the container without the aid of the spout in the first place. Hence, the ability of a closure to effectively close the container without repositioning the closure itself relieves the consumer in the case of paint container closures of the typical mess involved in pouring paint while providing such closure of the container as will ensure preservation of the fluid-tight seal necessary to store paint.

It is further desirable in a closure for a container that access into the container be provided so that small amounts of the contents may be retrieved without removing other amounts from the container first, such as would result when pouring the contents from a container. Such access may be provided by a secondary opening smaller than the closure itself but large enough to allow access, for example, by a scoop in the case of granulated or powdered contents or by a brush in the case of liquids such as paint.

SUMMARY OF THE INVENTION

The present invention provides for all of the above discussed desirable features in a closure for a container. Such features are provided in new, economical, straight-forward construction which is easily adaptable for use with a wide variety of containers.

A combined closure and pouring device for a container is disclosed which includes a spout and closure member, within which is formed an opening closable by a lid member. The closure device provides for convenient fluid-tight closing of the container by means of a closure member; convenient access to material within the container is provided by an opening in the closure member. The closure opening is easily closed by a sealing lid member. For controllable discharge of material from within the container, a spout is incorporated into the peripheral portion of the closure member. The disclosed combination further provides for convenient storage or shipping of the container since the closure may be oriented spout-down relative to the container without the spout interfering with the sides of adjacent containers. The disclosed invention is particularly adaptable for use with can-type container, such as paint cans, but may be adapted for use with a wide variety of containers of various shapes and sizes, with both threaded and non-threaded openings. The disclosed invention is particularly well suited for use with containers of fluid materials but is also useful with containers of granulated or powdered materials.

A closure device for a container is disclosed comprising: a closure member adapted to close the opening of the container and through which is provided a smaller opening adapted to allow material within the container to pass to the outside; a lid which is capable of providing fluid-light closure of the smaller opening of the closure member; and a spout extending from the peripheral portion of the closure member, which is adapted to controllably conduct away from the container material which has passed out of the container through the smaller opening in the closure member. The spout is adapted to avoid physical interference with the structure of the container when the closure device is oriented spout-down on the container.

The closure member of the disclosed invention is normally circular in shape and dimensioned so as to conform to the opening of the container with which it is to be used. It is contemplated that the closure member may take on many other shapes and sizes depending only on the shape and size of the opening of the container with which it is to be used.

In the preferred embodiment of the present invention, an upper annular flange which is integral with and extends from the peripheral portion of the closure member and which is adapted for frictional engagement with the opening of the container when the container closure is oriented spout-down; and a lower annular flange which is integral with and extends from the peripheral portion of the closure member and which is adapted for frictional engagement with the opening of the container when the container closure is oriented spout-up are provided. In the preferred form the upper and lower annular flanges are adapted for frictional engagement with the bead or chime of can-type containers. It is contemplated, however, that the upper and lower annular flanges may be adapted in other ways so as to effect fluid-tight closure contact with the opening of the container. More specifically, the upper and lower annular flanges may be adapted for threaded engagement with the threaded opening of jar-type containers.

Also in the preferred form the spout is integral with the upper annular flange and is oriented generally perpendicular to the plane of the closure member so that the spout is located to the side or exterior of the container when the container closure is oriented spout-down.

A lid annular flange is formed integral with and depending from the peripheral portion of the lid member. This smaller annular flange is adapted for frictional engagement with the opening of the closure member. In the preferred form the lid annular flange engages a second annular rib which is integral with and depends from the periphery of the smaller opening of the closure member. An annular rib which projects from the outer surface of the lid annular flange engages the free end of the second annular flange. Other forms of engagement, however, are contemplated whereby the requisite fluid-tight contact is effected. For example, the lid annular flange may be adapted for threaded engagement with the opening of the closure member.

In the disclosed invention, the lid member includes a small tab which extends from the upper surface of the lid member and which is adapted to facilitate removal of the lid member from the smaller opening of the closure member. In the preferred embodiment, the small tab extends from the peripheral portion of the lid member. Also in the preferred embodiment, the lid member includes a stiffening flange which depends from its lower surface.

Further, a combined closure and pouring device for use with a container having a top through which is provided at least one opening and having an exterior recess which is formed to receive the lower annular flange of the closure device when the closure device is oriented spout-up on the container and which is formed to receive the upper annular flange and the spout of the closure device when the closure device is oriented spout-down on the container is disclosed. This combined closure and pouring device includes a spout, a sealing lip which comprises the upper and lower flanges, and a closure member through which is provided at least one opening. The openings in the closure member which are similar in shape to the openings in the top of the container, are not aligned with the openings in the top of the container when the closure device is oriented spout-down on the container and can be alignable with the openings in the top of the container when the closure device is oriented spout-up on the container. In the preferred form, two openings are provided: an access hole and an air vent. These holes correspond with two similar openings provided in the top of the container: an access opening and an air vent. Only when the openings are aligned may material within the container flow to the outside.

The sealing lip is capable of providing fluid-tight closure contact between the closure member and the top of the container and is capable of providing such contact when the closure device is oriented spout-up or spout-down on the container. In the preferred form the sealing lip comprises: an upper annular flange integral with and extending from the peripheral portion of the closure member and which is adapted for frictional engagement with the container when the closure device is oriented spout-down; and a lower annular flange integral with and extending from the peripheral portion of the closure member and which is adapted for frictional engagement with the container when the closure device is oriented spout-up. Preferably the lower annular flange includes a shoulder which projects from the inner circumferential surface of the lower annular flange and which is adapted to provide increased frictional engagement with the container when said closure device is oriented spout-up by engaging with an annular groove provided in the outer circumferential surface of the exterior recess of the container near its top.

The spout extending from a peripheral portion of the closure member, is adapted to controllably conduct away from the container material which has passed out of the container when the closure device is oriented spout-up on the container and is adapted to closely contour the exterior structure of the container when the closure device is oriented spout-down on the container. Generally the spout is integral with the upper annular flange and perpendicular to the plane of the closure member so that it is located exterior to the side of the container when the closure device is oriented spout-down. In the preferred form the spout is molded so as to form a funnel when the closure device is oriented spout-up and is deformable to avoid physical interference with the exterior structure of the container or to fit within the exterior recess of the container as the case may be.

Other details, objects and advantages of the invention will become apparent from a consideration of the following description taken with the accompanying drawings.

DESCRIPTION OF THE PREFERRED EMBODIMENTS

Figure 15:
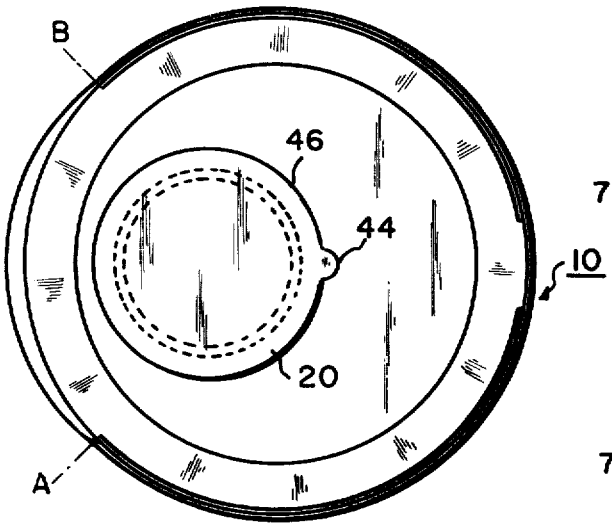
FIG. 15 is a plan view of a further embodiment of the disclosed invention.
Figure 16:
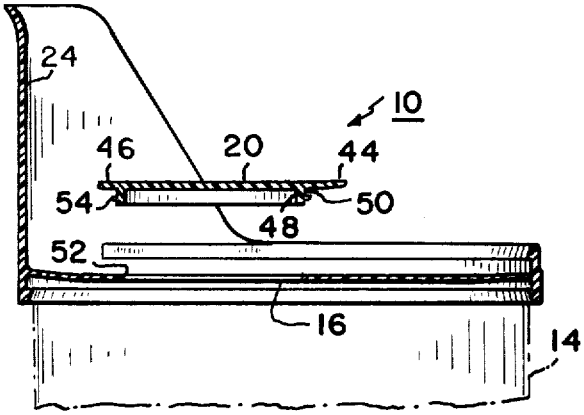
FIG. 16 is a sectional view of FIG. 15 in which the lid member is separated from the closure.
Figure 17:
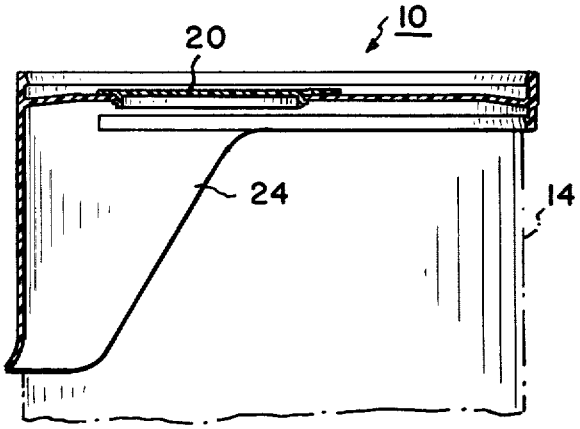
FIG. 17 is a sectional view of FIG. 15 in which the lid member is in the closed position and the closure is oriented spout-down on a can-type container.

Referring to the drawings, there is shown a combined closure and pouring device for use with a container having at least one opening. The combined closure and pouring device, hereinafter referred to simply as "closure device", is shown in FIGS. 1–14, for use with can-type paint containers. An embodiment of the closure device is shown in FIGS. 15–17, for use with can-type containers in general. As will be fully described hereinafter, the closure device may be adapted for use with a wide variety of both can and jar containers. In FIGS. 18–24, a further embodiment of the closure device which is adapted for use with a container having a top with at least one opening and, preferably, an exterior recess configured complementary with the structure of the closure device. The combination of this embodiment of the closure device and the disclosed complementary container may be variously adapted to serve as a convenient marketing device for a wide variety of products.

Figure 1:
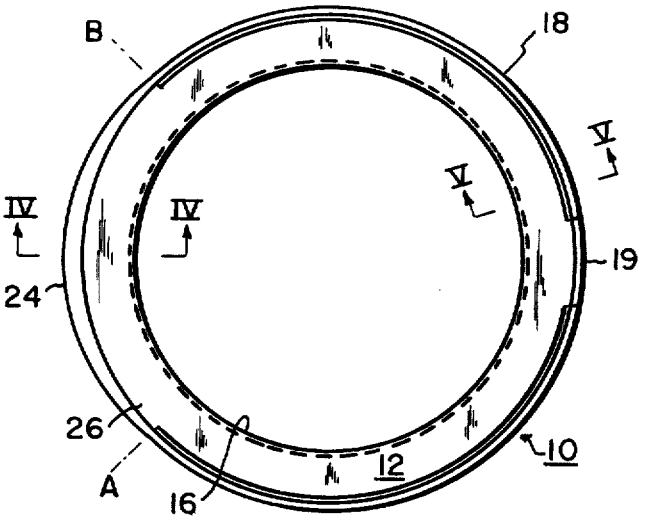
FIG. 1 is a plan view of an embodiment of the closure member, adapted for use with a can-type paint container.
Figure 2:
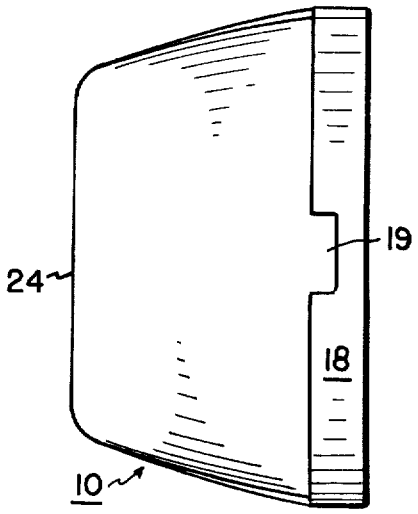
FIG. 2 is a side elevational view of FIG. 1.
Figure 3:
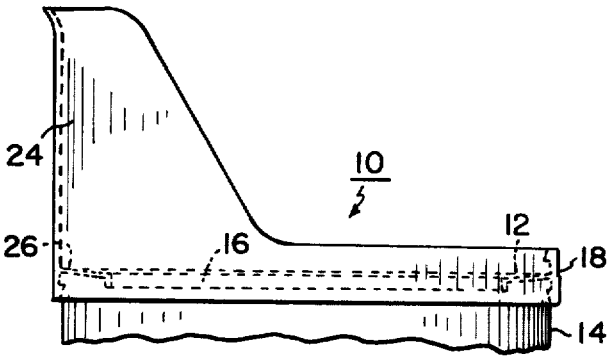
FIG. 3 is a front elevational view of FIG. 1.

Referring particularly to FIGS. 1–8, there is shown a closure device 10 for a container 14. In FIGS. 1–8, container 14 is a typical paint can container. As shown in FIGS. 1–3, closure device 10 includes a flanged closure portion 12 which is adapted to close the opening of container 14. Flanged closure portion 12 is provided with a smaller inner opening 16, and a formed depending flange 18 which is capable of providing fluid-tight closure contact between closure portion 12 and the opening of container 14. Sealing flange 18 provides fluid-tight contact when closure device 10 is oriented spout-up or spout-down on container 14. A spout 24 extends from a peripheral portion 26 of closure portion 12. Opening 16 of closure portion 12 allows material within container 14 to pass to the outside when closure device 10 is placed over the opening of container 14. Spout 24 is adapted to controllably conduct away from container 14 material which has passed out of container 14 through opening 16 when closure device 10 is oriented spout-up on container 14 and is further adapted to avoid physical interference with the structure of container 14 when closure device 10 is oriented spout-down on container 14.

Figure 6:
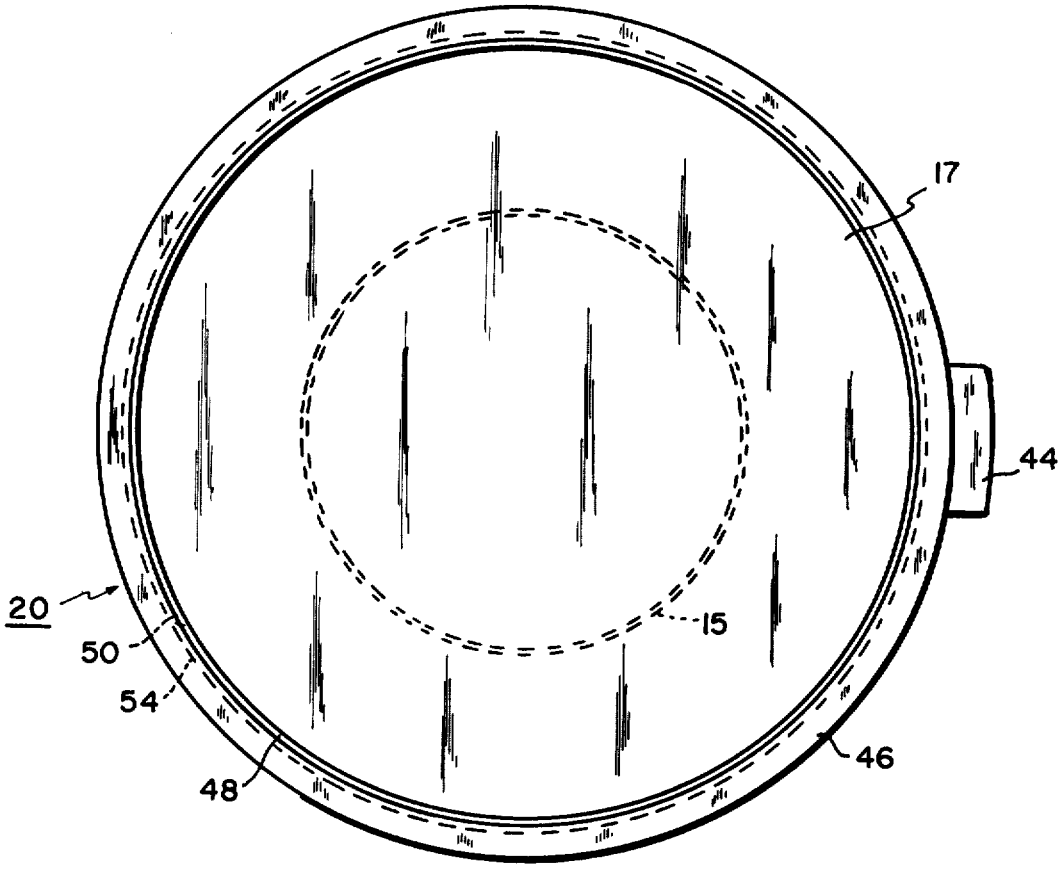
FIG. 6 is a plan view of the lid member, adapted for use with the closure member shown in FIG. 1.
Figure 7:
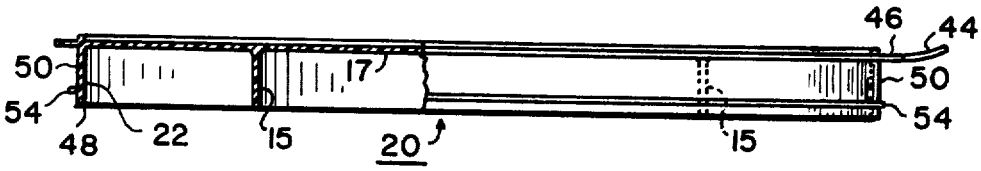
FIG. 7 is a partial sectional and partial elevational view of FIG. 6.
Figure 8:
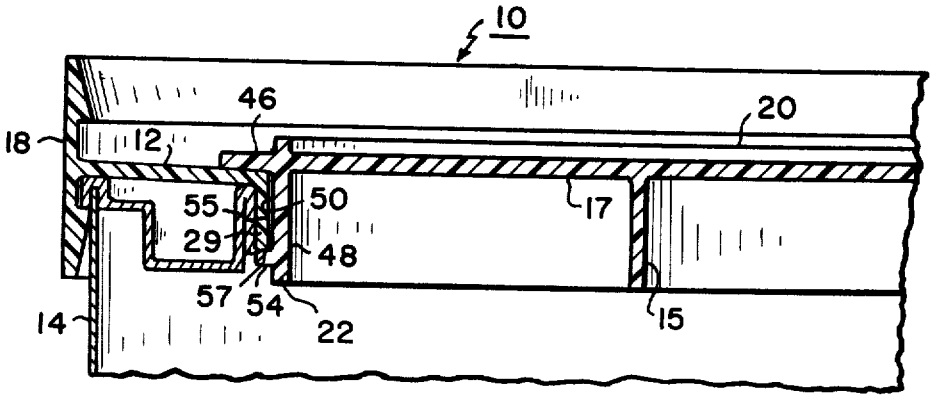
FIG. 8 is a partial sectional view of the lid member of FIG. 6 in place on the closure member of FIG. 1.
Figure 9:
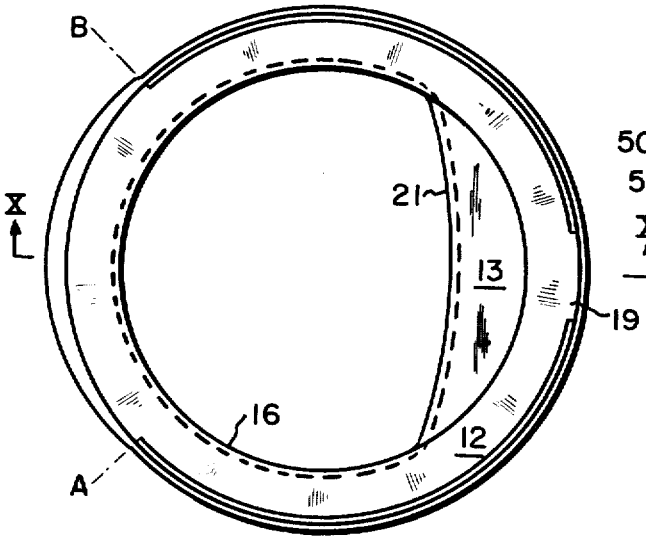
FIG. 9 is a plan view of another embodiment of the closure member, adapted for use with a can-type paint container.
Figure 12:
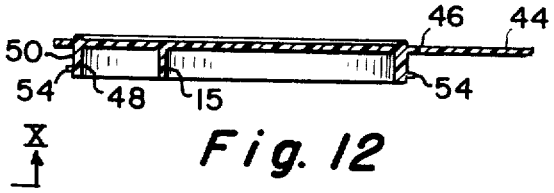
FIG. 12 is a sectional view taken along XII—XII of FIG. 11.
Figure 10:
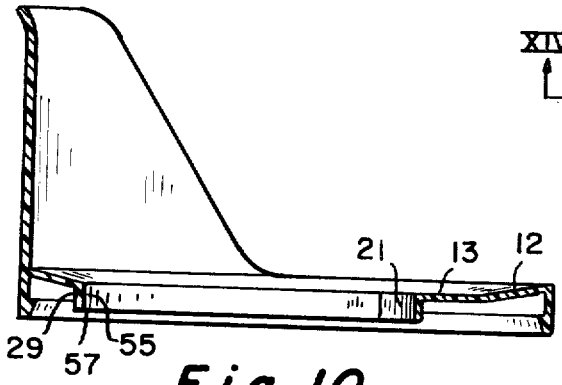
FIG. 10 is a sectional view taken along X—X of FIG. 9.

As shown in FIGS. 6–8, closure device 10 further includes lid member 20 adapted to close smaller opening 16 of portion 12. Lid 20 is also provided with a sealing flange which provides a fluid-tight seal between lid 20 and opening 16.

Closure portion 12 is normally circular in shape, as shown in FIG. 1, and is dimensioned so as to close the opening of container 14. It is, however, understood that closure portion 12 may take on many shapes and sizes depending only on the shape and size of the opening of the container with which it is to be used. Flanged closure portion 12 is formed as a plate which may be perfectly flat or slightly convex or concave. In the preferred embodiment, shown most clearly in FIGS. 3–5, portion 12 is formed as an annular plate which is slightly concave so as to facilitate drainage of material, particularly fluids, from the peripheral portions into opening 16 when pouring operations are completed. Portion 12 is formed as a plate of uniform thickness; however, closure portion 12 may be formed as a plate having non-uniform thickness or slight depressions, which may facilitate drainage as described above.

Like portion 12, opening 16 is normally circular in shape, as shown in FIG. 1. However, opening 16 may assume any shape depending on the pouring characteristics desired, the type of material to be poured from the container, or other considerations. Another embodiment of the invention, shown in FIGS. 9–14, discloses a variation in the shape of opening 16 which is particularly well-suited for use with can-type paint containers. The larger surface area 13 of closure portion 12 opposite the spout serves as a convenient brush rest. In addition, the flattened portion 21 of opening 16 serves as a convenient edge against which to pass a paint brush to remove excess paint.

Similarly, the size of opening 16 may vary from very small to nearly as large as closure portion 12 itself. Indeed, in the preferred embodiment, shown in FIG. 1, opening 16 is nearly as large as closure portion 12. A third embodiment of the invention, shown in FIGS. 15–17, discloses a variation in the size of opening 16 which is much smaller than closure portion 12.

The position of smaller opening 16 in closure portion 12 can be varied as desired. In the preferred embodiment of the invention, shown in FIG. 1, smaller opening 16 is located concentrically in closure portion 12. In the embodiments shown in FIGS. 15 through 24, smaller opening 16 is located slightly off center toward spout 24 and symmetrical with respect to spout 24.

Figure 4:
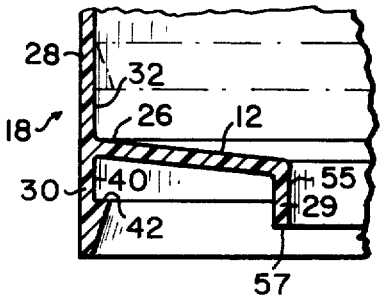
FIG. 4 is a sectional view taken along IV—IV of FIG. 1.
Figure 5:
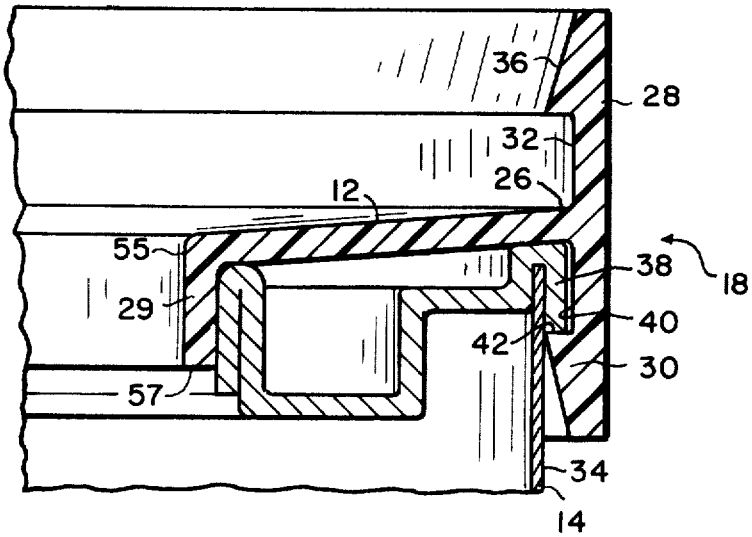
FIG. 5 is a sectional view taken along V—V of FIG. 1.

The details of sealing flange 18 are shown in FIGS. 3–5. These figures show sealing flange 18 of the preferred embodiment of the invention which is adapted for use with a can-type paint container. With particular reference to FIG. 5, sealing flange 18 comprises: an upper annular flange 28 which is integral with and extends from the periphery 26 of closure portion 12 and which is capable of effecting fluid-tight closure between closure portion 12 and the opening of container 14 when closure 10 is oriented spout-down; and a lower annular flange 30 which is similarly integral with and extends from the periphery 26 of closure member 12 and which is capable of effecting fluid-tight closure between closure portion 12 and the opening of container 14 when closure 10 is oriented spout-up.

In the preferred embodiment, upper annular flange 28 is adapted to provide a seal between closure portion 12 and the opening of container 14 by frictional engagement of its inner circumferential surface 32 with the outer circumferential surface 34 of container 14. Sufficient frictional engagement to assure fluid-tight closure is accomplished by constructing upper annular flange 28 so that the circumference of its inner surface 32 is slightly less than that of the outer surface 34 of container 14.

In addition, further frictional engagement is accomplished by constructing a shoulder 36 on the free end of upper annular flange 28. Shoulder 36 is adapted to fit over and grasp chime 38 of can-type containers so as to provide positive engagement of upper annular flange 28 with the opening of container 14. Constructed as described above, upper annular flange 28 provides sufficient frictional engagement of closure portion 12 with the opening of container 14 to assure a fluid-tight seal.

However, in another preferred embodiment, the construction of upper annular flange 28 is slightly modified from the above description. Opposite spout 24, upper annular flange 28 is provided with thumb access 19. Thumb access 19 is provided to facilitate removal of lid member 20, as will be more fully described hereinafter. Upper annular flange 28 is further modified in the preferred embodiment by discontinuing shoulder 36 in the area of spout 24. Such discontinuity of shoulder 36 is provided to assure a smooth, unobstructed flow of material during pouring operations. As a result of such modifications only such frictional engagement as is required to hold closure 10 onto container 14 when shipping, storing or stacking is provided.

Lower annular flange 30 is similarly adapted to effect a fluid seal between closure portion 12 and the opening of container 14 by frictional engagement of its inner circumferential surface 40 with the outer circumferential surface 34 of container 14. Frictional engagement sufficient to assure fluid-tight closure is accomplished by constructing lower annular flange 30 so that the circumference of its inner circumferential surface 40 is slightly less than that of the outer circumferential surface 34 of container 14. Similarly further frictional engagement is accomplished by constructing a shoulder 42 on the inner circumferential surface of lower annular flange 30. Like shoulder 36, shoulder 42 is adapted to fit over and grasp chime 38 of can-type containers so as to provide positive engagement of lower annular flange 30 with the opening of container 14. So constructed lower annular flange 30 provides sufficient frictional engagement of closure member 12 with the opening of container 14 to assure a fluid-tight seal when closure device 10 is oriented spout-up on container 14.

When closure device 10 is to be used in conjunction with containers other than can-type paint containers, sealing flange 18 may be adapted accordingly. That is, sealing flange 18 may be variously embodied so as to provide the needed fluid-tight closure contact between closure portion 12 and the opening of many different types and configurations of containers, including non-can-type containers. For example, the needed engagement may be effected by constructing inner circumferential surfaces 32 and 40 with threads to match the threads of the outer circumferential surface of containers with threaded openings.

As a further variation, sealing flange 18 may be adapted to provide frictional or threaded engagement with the inner surfaces of the container opening with which closure device 10 is used, as distinguished from the embodiment which provides for engagement with the outer surfaces of the container opening. Such a configuration would be particularly advantageous for use with a container having an opening smaller and/or of different shape from its top. Rectangularly shaped portable gasoline, oil or antifreeze containers with small circular openings on their tops are examples of such containers. In such an embodiment spout 24 would fit interior of the container when closure 10 was oriented spout-down, as distinguished from fitting exterior of the container in the preferred embodiment described more fully hereinafter.

In the preferred form of the disclosed invention, shown in FIGS. 1–3, spout 24 is integral with the upper annular flange 28. Spout 24 extends from a portion of upper annular flange 28 defined in FIG. 1 by the circumferential distance A–B, measured clockwise. It is understood that circumferential distance A–B may be varied as desired. Likewise, the thickness, general shape and length of spout 24 may be varied. In the preferred embodiment, as shown in FIGS. 1–3, spout 24 is oriented generally perpendicular to the plane of closure portion 12. As a result of such orientation, spout 24 fits exterior to the side of container 14, when closure device 10 is oriented spout-down, as shown in the upper part of FIG. 17. This feature of spout 24 provides for close adherence to but avoidance of physical interference with the structure of container 14 when the closure device is oriented spout-down, thereby providing for convenient shipping or storing. It is contemplated, however, that spout 24 may be oriented at an angle other than perpendicular to the plane of closure portion 12 so as to suit the side configuration of particular containers.

Figure 13:
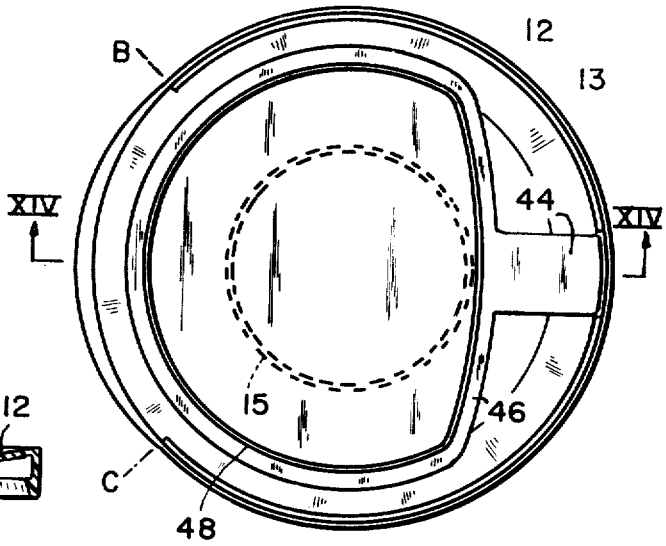
FIG. 13 is a plan view of the lid member of FIG. 11 in place on the closure member of FIG. 9.
Figure 11:
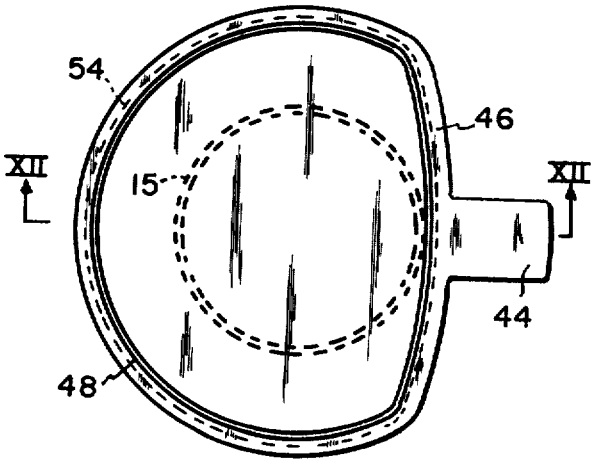
FIG. 11 is a plan view of the lid member, adapted for use with the closure member shown in FIG. 9.
Figure 14:
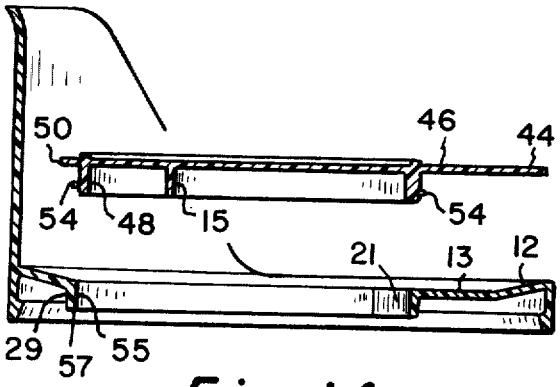
FIG. 14 is a sectional view taken along XIV—XIV of FIG. 13, but with the lid spaced apart from the closure member.

The preferred embodiment of lid member 20 is shown in FIGS. 6 and 7. Normally circular in shape, lid 20, like opening 16 of closure portion 12, may assume very nearly any shape. The shape of lid member 20 in another embodiment of the invention is shown in FIGS. 11 and 13. As FIGS. 9–13 make clear, the shape of lid member 20 may differ from that of smaller opening 16, but it must be of such a size as will cover opening 16 and generally would not be larger than closure portion 12. As shown in FIGS. 6–7, lid member 20 is normally a flat plate of uniform thickness. However, lid member 20 may be slightly concave or convex and may contain depressions or irregularities as desired. As shown in FIGS. 6, 7, 11, 13 and 15, lid member 20 includes a small tab 44 which extends from the peripheral portion 46. it is understood, however, that tab 44 may extend from any part of the upper surface of lid member 20 in keeping with its purpose to facilitate removal of lid member 20 from opening 16.

In the preferred embodiment lid member 20 includes a stiffening flange 15 which is concentric with the outline of lid member 20 and which depends from the lower surface 17 of lid member 20. Both the embodiment shown in FIGS. 6–8 and the embodiment shown in FIGS. 9–14 have a stiffening flange 15. However, the presence of stiffening flange 15 is not necessary to the practice of the invention. The embodiment of the invention shown in FIGS. 15–18 does not have stiffening flange 15.

In its most elementary form, second sealing flange 22 comprises an annular flange 48 which is integral with and depends from the peripheral portion 46 of lid member 20. Annular flange 48 is capable of effecting a fluid-tight seal between lid member 20 and opening 16 by frictional engagement of its outer circumferential surface 50 with the inner circumferential edge 52 of opening 16, as shown in FIG. 16. Such frictional engagement may be enhanced by providing a rib 54, shown in FIGS. 7, 8, 12, 14 and 16. The embodiment shown in FIGS. 15–17 illustrates this elementary form of sealing flange 22.

A preferred embodiment of sealing flange 22 is shown in FIGS. 6–8. With particular reference to FIG. 8, sealing flange 22 comprises: a first annular flange 48 and annular rib 54, discussed above, which engage annular flange 29 which is integral with and depends from closure portion 12 at the periphery of opening 16. This embodiment of sealing flange 22 is capable of effecting fluid-tight closure contact between lid member 20 and opening 16 by frictional engagement of the outer circumferential surface 50 of first annular flange 48 with the inner circumferential surface 55 of second annular flange 29. Such frictional engagement is enhanced by locating annular rib 54 so that the distance between annular rib 54 and the lower surface 17 of lid member 20 is equal to or slightly less than the distance between the free end 57 of annular flange 29 and the upper surface of closure portion 12. So located annular rib 54 grasps the free end 57 of annular flange 29 so as to assure positive contact between the underside 17 of the peripheral portion 46 of lid member 20 with the upper surface of closure portion 12 as well as to provide greater frictional engagement of the outer circumferential surface 50 of first annular flange 48 with the inner circumferential surface 55 of second annular flange 29.

Sealing flange 22 may be embodied so as to accomplish the requisite fluid-tight closure contact by threaded engagement instead of the frictional engagement described above. For example, such contact may be effected by constructing outer circumferential surface 50 of a flange 48 with threads which match the threads constructed on the inner circumferential edge 52 or on the inner circumferential surface 55 of second annular flange 29.

Figure 22:
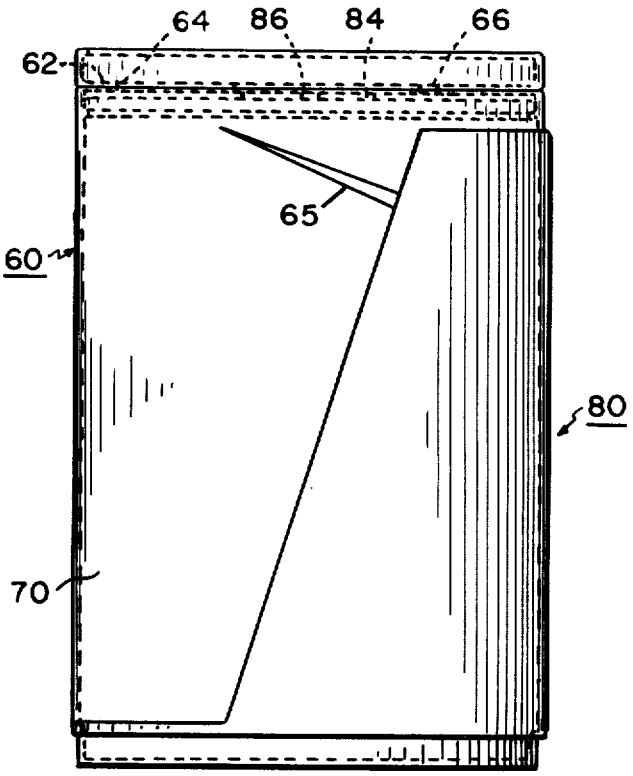
FIG. 22 is a side elevation view of the container shown in FIG. 20 with the embodiment of the invention shown in FIG. 18 oriented spout-down.
Figure 23:
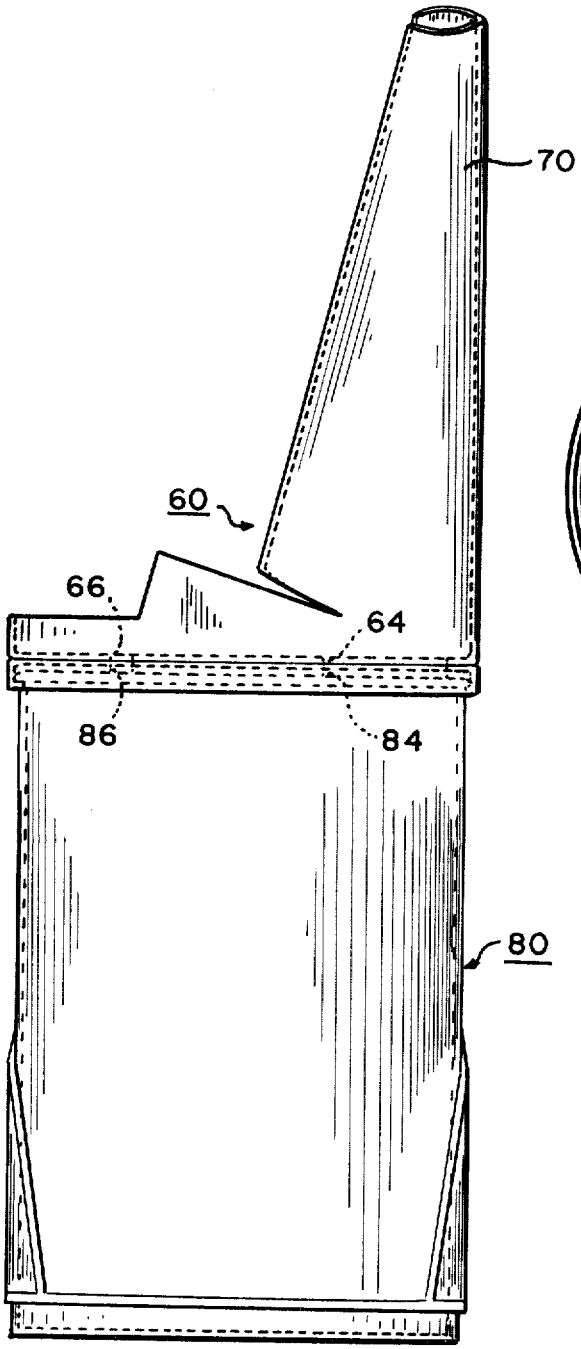
FIG. 23 is a side elevation view of the container and embodiment of the disclosed invention shown in FIG. 22 after the disclosed closure device has been placed spout-up on the container.
Figure 24:
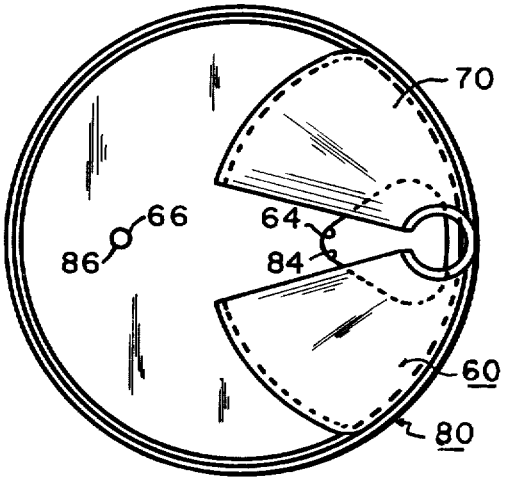
FIG. 24 is a plan view of the container and embodiment of the invention shown in FIG. 22 with the closure device placed spout-up on the container.

Referring particularly to FIGS. 18–24, there is shown a closure device 60 and a container 80. As shown in FIGS. 22–24, closure device 60 is adapted for use with container 80, which is adapted to complement the structure of closure device 60. In combination closure device 60 and container 80 serve as an ideal container for marketing liquid products for consumer use, such as automobile oil. As will be described more fully hereinafter, such a combination provides many advantages which have great consumer appeal. Furthermore, such a combination may be variously adapted to serve as a convenient marketing device for many other products, including powdered and granular products.

Figure 18:
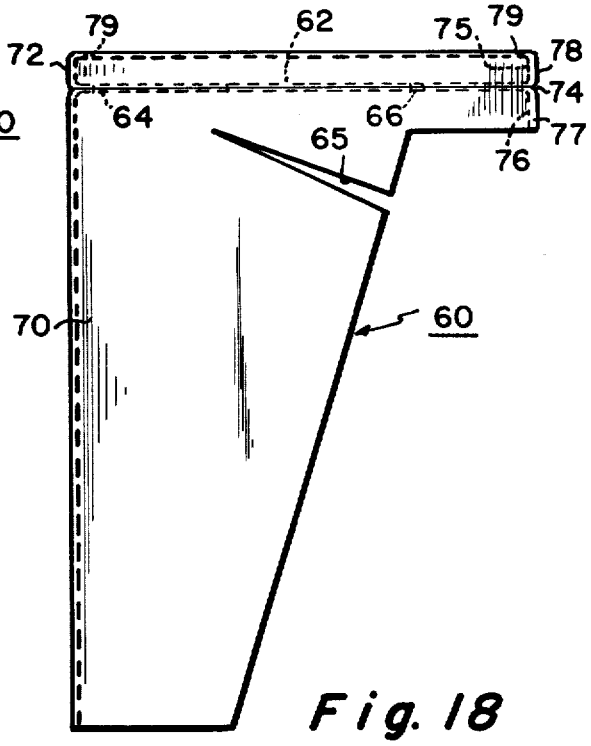
FIG. 18 is a side elevational view of a further embodiment of the disclosed invention adapted for use with the container shown in FIG. 20.
Figure 19:
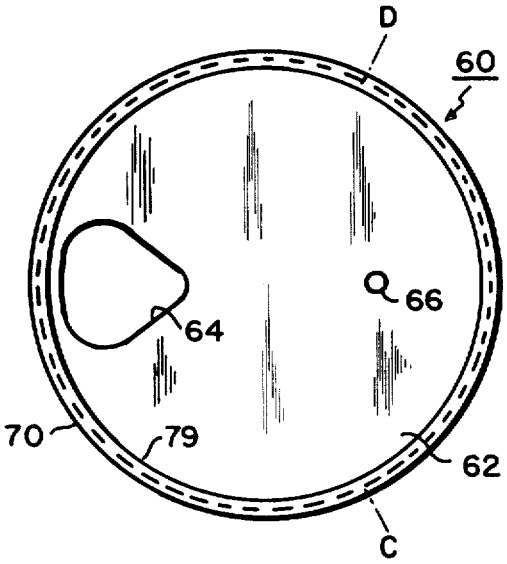
FIG. 19 is a plan view of FIG. 18.

As shown in FIGS. 18–19, closure device 60 includes closure portion 62 through which is provided an access hole 64 and an air vent hole 66, a lip 74 which is capable of providing a fluid-tight seal between closure member 62 and the top 82 of container 80. Lip 74 is capable of providing a fluid-tight seal when closure device 60 is oriented spout-up or spout-down on container 80. A spout 70 extends from a peripheral portion 72 of closure portion 62, which is adapted to controllably conduct away from container 80 material which has passed out of the container when closure device 60 is oriented spout-up and which is adapted to avoid physical interference with adjacent containers 80 or the exterior structure of container 80 when closure device 60 is oriented spout-down.

Access hole 64 may be variously formed, in keeping with its purpose, to allow for the flow of material out of container 80 through access opening 84. Such out-flow may take place when closure device 60 is placed spout-up on container 80 and positioned so that access hole 64 is aligned with access opening 84. Hence, access hole 64 is generally of the same size and shape as access opening 84 and is positioned in closure portion 62 so that it may be aligned with access opening 84. Generally, this requires that access hole 64 be positioned off-center toward spout 70 and symmetrical with respect to spout 70. Air vent 66 may also be variously formed, and in some embodiments, such as those designed to contain granular products, may be deleted altogether. Air vent 66 is generally similar in size and shape to air vent 86, provided in the top 82 of container 80. Air vent 66 is positioned in closure portion 62 so that it is aligned with air vent opening 86 when access hole 64 is aligned with access opening 84.

Lip 74 comprises upper flange 77 and lower flange 78. Upper annular flange 77 is integral with and extends from the peripheral portion 72 of closure portion 62. Flange 77 is adapted for frictional engagement with the container 80 when closure device 60 is oriented spout-down. Lower annular flange 78 is integral with and extends from the peripheral portion 72 of closure member 62 and is adapted for frictional engagement with the container 80 when closure device 60 is oriented spout-up. In general, lip 74 functions in the same manner as sealing flange 18 and may be variously adapted for frictional or threaded engagement as described hereinabove with reference to sealing flange 18. In the preferred form lip 74 provides the requisite seal by frictional engagement between the inner surface 75 of lower flange 78 and outer surface 85 of container 80 when closure device 60 is oriented spout-up. A seal is provided by frictional engagement of the inner circumferential surface 76 of upper annular flange 77 and outer circumferential surface 85 of container 80 when closure device 60 is oriented spout-down. Such frictional engagement may be enhanced by providing shoulder 79 which projects from the inner circumferential surfaces 75 and 76 of annular flanges 77 and 78. In the preferred form, shoulder 79 is provided only on the inner circumferential surface 75 of lower annular flange 78. Such frictional engagement may be further enhanced by providing annular groove 89 which is located on outer circumferential surface 85 of container 80 so that shoulder 79 engages therewith when closure device 60 is oriented spout-up on container 80. So constructed lip 74 provides the requisite fluid seal between closure portion 62 and container 80.

In the preferred embodiment, spout 70 is integral with upper annular flange 77 as shown in FIG. 18. Spout 70 extends from a portion of upper annular flange 77 defined in FIG. 19 by the circumferential distance C–D, measured clockwise. Like circumferential distance A–B on spout 24, circumferential distance C–D on spout 70 may be varied as desired. Likewise, the thickness, general shape and length of spout 70 may be varied. Spout 70 is oriented generally perpendicular to closure surface 62. As a result of such orientation, spout 70 may fit exterior and close to the side of container when closure device 60 is oriented spout-down. This feature of spout 70 provides for avoidance of physical interference with the structure of container 80 when the closure device is oriented spout-down, thereby providing for convenient shipping or storing. Generally, spout 70 is adapted to fit within an exterior recess 88 provided in the side of container 80; the function of recess 88 will be more fully described hereinafter.

In the preferred form, spout 70 is molded so that its natural shape or form is that of a funnel as shown in FIG. 24. However, in this form, spout 70 is constructed of a material which allows it to be deformed into a shape which will follow the contour of container 80 or the exterior recess 88 of container 80, as the case may be, when closure device 60 is oriented spout-down container 80. In order to provide for such deformability without causing undue stress to the spout, slit 65 is cut in each edge of spout 70. It is understood that slit 65 may be varied in length, width and general configuration so as to best lessen stress in the spout for various applications.

Figure 20:
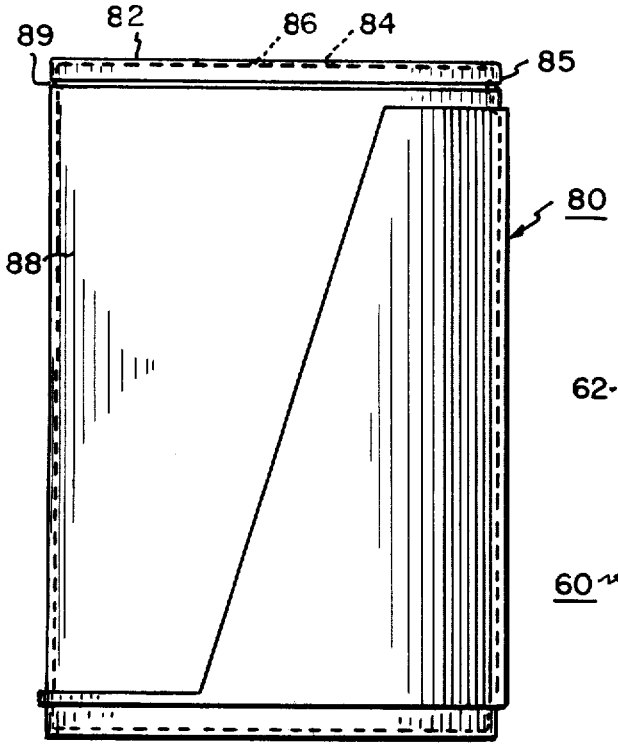
FIG. 20 is a side elevational view of a container adapted for use with the embodiment of the disclosed invention shown in FIG. 18.
Figure 21:
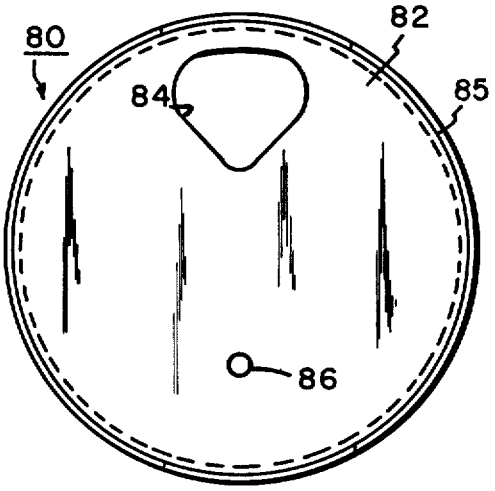
FIG. 21 is a plan view of FIG. 20.

The details of container 80 are shown in FIGS. 20–21. Container 80 in the preferred form comprises: a top 82 through which is provided an access opening 84 and an air vent opening 86 and an exterior recess 88 which is formed to receive lip 74 of closure device 60 when closure device 60 is oriented spout-up and which is further formed to receive lip 74 and spout 70 of closure device 60 when closure device 60 is oriented spout-down on container 80.

The size, shape and location of access opening 84 in top 82 of container 80 may be varied in keeping with its purpose to provide for the flow of material out of container 80. Likewise, the size, shape and location of air vent 86 may be varied. As described above, access 64 and air vent 66 are of such size and shape and location that they may be aligned with access opening 84 and air vent opening 86 and when so aligned, provide for the flow of materials from container 80.

Exterior recess 88 as shown in FIG. 20, encompasses the entire outer circumferential surface 85 of container 80 near its top 82 and a sufficiently large area of the side of container 80 as will accommodate spout 70 when closure device 60 is oriented spout-down on container 80. The center of the large portion of exterior recess 88 is located on the side of container 80 displaced 90° from the side toward which access opening 84 is located. By so locating exterior recess 88, access hole 64 in closure member 62 cannot be aligned with access opening 84 of top 82 when closure device 60 is oriented spout-down on container 80. This assures the integrity of the closure device and container in combination when it is being stored or shipped. Since exterior recess 88 encompasses the entire outer circumferential surface 85 of container 80 near its top 82, closure device 60 may be positioned spout-up on container 80 with holes 64 and 66 either aligned with openings 84 and 86 or not as desired. This provides for convenient opening, closing and pouring by consumers. Also as hereinbefore discussed, exterior recess 88 may include an annular groove 89. Annular groove 89 is located so as to engage with shoulder 79 of lower annular flange 78 when closure device 60 is oriented spout-up on container 80.

In the embodiments of the disclosed invention, all elements of closure devices 10 and 60 are composed of a flexible plastic material, such as polyethylene. The use of polyethylene is particularly desirable in the molding of spout 70 because of its deformability. Such a composition is particularly suited for those embodiments wherein sealing flange 18, 22 or sealing lip 74 effect fluid-tight closure by frictional engagement as hereinbefore described. It is contemplated, however, that closure devices 10 and 60 may be composed of other materials, even those which would result in a rigid or semi-rigid structure, such as hard plastics or metals. Such compositions are better suited for those embodiments wherein portions 18, 22 or 74 effect fluid-tight closure by threaded engagement. It is further contemplated that not all of the elements of closure devices 10 and 60 must be composed of the same material. For example, lid member 20 and flange 22 may be composed of rigid material while the other elements of closure device 10 are composed of flexible material. In such ways, the composition of closure devices 10 and 60 may be varied so as to adapt to suit many different containers and many different uses.

What is claimed is:

1. A closure and pouring device for use with a container for material having at least one opening comprising:

a. a closure member adapted to close the opening of the container and through which is provided an opening adapted to allow material within the container to pass to the outside;

b. a spout extending from a peripheral portion of said closure member which is adapted to controllably conduct away from the container material which has passed out of the container through the opening in said closure member when said closure device is oriented spout-up on the container and which is adapted to extend external to and avoid physical interference with the structure of the container when said closure device is oriented spout-down on the container;

c. first means for engagement which is capable of providing fluid-tight closure contact between said closure member and the opening of the container when said closure device is oriented spout-up or spout-down on the container;

d. a lid member adapted to close the opening of said closure member; and e. second means for engagement which is capable of providing fluid-tight closure contact between said lid member and the opening of said closure member.

2. The closure and pouring device recited in claim 1 wherein said closure member is circular in shape and wherein said first means for engagement comprises:

a. an upper annular flange integral with and extending from the peripheral portion of said closure member and which is adapted for frictional engagement with said container when said closure device is oriented spout-down; and b. a lower annular flange integral with and extending from the peripheral portion of said closure member and which is adapted for frictional engagement with said container when said closure device is oriented spout-up.

3. The combined closure and pouring device recited in claim 2 wherein said upper and lower annular flanges each comprise: an annular shoulder which projects from the inner circumferential surface of the associated annular flange and which is adapted for frictional engagement with the chime of the opening of can-type containers.

4. The combined closure and pouring device recited in claim 2 wherein said upper and lower annular flanges are adapted for threaded engagement with the threaded opening of jar-type containers.

5. The combined closure and pouring device recited in claim 2 wherein said spout is integral with said upper annular flange and is oriented generally perpendicular to the plane of said closure member and said spout extends along the exterior and in close proximity to the side of the container when said closure device is oriented spout-down.

6. The combined closure and pouring device recited in claim 1 wherein said second means for engagement comprises a first annular flange integral with and depending from the peripheral portion of said lid member and which is adapted for frictional engagement with the opening of said closure member.

7. The combined closure and pouring device recited in claim 6 wherein said first annular flange comprises: an annular rib which projects from the outer circumferential surface of said first annular flange and which is adapted for frictional engagement with the opening of said closure member.

8. The combined closure and pouring device recited in claim 6 wherein said second means for engagement further comprises a second annular flange which is integral with and depends from the periphery of said smaller opening of said closure member and wherein said first annular flange is adapted for frictional engagement with said second annular flange.

9. The combined closure and pouring device recited in claim 6 wherein said first annular flange is adapted for threaded engagement with the opening of said closure member.

10. A closure for a container as recited in claim 1 wherein said lid member comprises a small tab extending from its peripheral portion and adapted to facilitate removal of said lid member from the opening in said closure member.

11. A combined closure and pouring device for use with a container having a top through which is provided at least one opening, comprising:

a. a closure member through which is provided at least one opening, which opening is similar in shape to the opening provided in the top of the container;

b. a spout extending from a peripheral portion of said closure member which is adapted to conduct away from the container material which has passed out of the container when said closure device is oriented spout-up on said container and which is adapted to avoid physical interference with the exterior structure of the container when said closure device is oriented spout-down on the container;

c. means for engagement which is capable of providing fluid-tight closure contact between said closure member and the top of the container when said closure device is oriented spout-up or spout-down on the container; and d. aligning means for off-setting the opening in said closure member from the opening in the top of the container when said closure member is oriented spout-down and permitting alignment with the opening in the top of the container when said closure member is oriented spout-up on the container.

12. The combined closure and pouring device recited in claim 11 wherein said means for engagement comprises:

a. an upper annular flange integral with and extending from the peripheral portion of said closure member and which is adapted for frictional engagement with the container when said closure device is oriented spout-down; and b. a lower annular flange integral with and extending from the peripheral portion of said closure member and which is adapted for frictional engagement with the container when said closure device is oriented spout-up.

13. The combined closure and pouring device recited in claim 12 wherein said lower annular flange includes a shoulder which projects from the inner circumferential surface of said lower annular flange and which is adapted to provide increased frictional engagement with the container when said closure device is oriented spout-up.

14. The combined closure and pouring device recited in claim 11 wherein said openings in said closure member and in the top of the container include a pouring hole, adapted to allow material to be poured out of the container, and an air-vent hole, adapted to facilitate pouring liquids from the container.

15. The combined closure and pouring device recited in claim 11 wherein said spout is molded so as to form a funnel when said closure device is oriented spout-up and is deformable to avoid physical interference with the exterior structure of the container when said closure device is oriented spout-down.

16. The combined closure and pouring device recited in claim 12 wherein said spout is integral with said upper annular flange and is oriented generally perpendicular to the plane of said closure member whereby said spout is located exterior to the side of the container when said closure device is oriented spout-down.

17. A spouted closure for use with a container, having a top through which is provided at least one opening and an exterior recess, comprising:

a. a closure member through which is provided at least one opening, which opening is similar in shape to the opening provided in the top of the container, not aligned with the opening provided in the top of the container when said spouted closure device is oriented spout-down on the container, and is alignable with the opening provided in the top of the container when said closure device is oriented spout-up on the container;

b. means for engagement which engages in a fluid-tight relationship with the container at its exterior recess providing fluid-tight closure contact between said closure member and the top of the container and which is capable of providing such contact when said closure device is oriented spout-up or spout-down on the container; and c. a spout extending from a peripheral portion of said closure member which is adapted to controllably conduct away from the container material which has passed out of the container when said closure device is oriented spout-up on said container and which is adapted to fit within the exterior recess of the container when said closure device is oriented spout-down on the container.

18. The spouted closure recited in claim 17 wherein said means for engagement comprises:

a. an upper annular flange integral with and extending from the peripheral portion of said closure member and which is adapted for frictional engagement with the container when said closure device is oriented spout-down; and b. a lower annular flange integral with and extending from the peripheral portion of said closure member and which is adapted for frictional engagement with the container when said closure device is oriented spout-up.

19. The spouted closure recited in claim 18 wherein said lower annular flange includes a shoulder which projects from the inner circumferential surface of said lower annular flange and which is adapted to provide increased frictional engagement with the container when said closure device is oriented spout-up.

20. The spouted closure recited in claim 17 wherein the access openings in said closure member and in the top of the container include a pouring hole, adapted to allow material to be poured out of the container, and an air-vent hole, adapted to facilitate pouring liquids from the container.

21. The spouted closure recited in claim 17 wherein said spout is molded so as to form a funnel when said closure device is oriented spout-up and is deformable to fit within the exterior recess of the container when said closure device is oriented spout-down.

22. The spouted closure recited in claim 18 wherein said spout is integral with said upper annular flange and is oriented generally perpendicular to the plane of said closure member.

23. A spouted closure and container combination comprising:

a. a container comprising (1) a top through which is provided at least one opening and (2) an exterior recess; and b. a spouted closure device which comprises (1) a closure member through which is provided at least one opening which opening is similar in shape to the opening provided in the top of said container, and is not aligned with the opening provided in the top of said container when said spouted closure device is oriented spout-down on said container and is alignable with the opening provided in the top of said container when said closure device is oriented spout-up on said container, (2) a means for engagement which is capable of providing fluid-tight closure contact between said closure member and the top of said container and which is capable of providing such contact when said spouted closure device is oriented spout-up or spout-down on said container, and (3) a spout extending from a peripheral portion of said closure member which is adapted to controllably conduct away from said container material which has passed out of said container when said spouted closure device is oriented spout-up on said container and which is adapted to fit within the exterior recess of said container when said spouted closure device is oriented spout-down on said container.

24. The combination recited in claim 23 wherein said means for engagement of said spouted closure device comprises:

a. an upper annular flange integral with and extending from the peripheral portion of said closure member and which is adapted for frictional engagement with said exterior recess of said container when said spouted closure device is oriented spout-down; and b. a lower annular flange integral with and extending from the peripheral portion of said closure member and which is adapted for frictional engagement with said exterior recess of said container when said spouted closure device is oriented spout-up.

25. The container recited in claim 24 wherein said lower annular flange includes a shoulder which projects from the inner circumferential surface of said lower annular flange and which is adapted to engage with said exterior recess of said container when said spouted closure device is oriented spout-up.

26. The combination recited in claim 23 wherein the access openings in said closure member and in the top of said container include a pouring hole, adapted to allow material to be poured out of said container, and an air-vent hole, adapted to facilitate pouring liquids from said container.

27. The combination recited in claim 25 wherein said exterior recess of said container includes an annular groove provided in the outer circumferential surface of said recess and adapted to receive said shoulder of said lower annular flange when said closure device is oriented spout-up on said container.

28. The combination recited in claim 23 wherein said spout of said closure device is molded so as to form a funnel when said closure device is oriented spout-up and is deformable to fit within said exterior recess of said container when said closure device is oriented spout-down.

29. The combined closure and pouring device recited on claim 24 wherein said spout is integral with said upper annular flange and is oriented generally perpendicular to the plane of said closure member.

30. A closure and pouring device for a cylindrical shaped can having a top opening comprising:

a closure member, having a surface through which an opening is formed, positionable on the can in a pouring position, wherein one side of the surface is exposed, and in a non-pouring position, wherein the other side of the surface is exposed;

a lid member for fluid-tight closure of the opening in said closure member movable to open the opening in said closure member when said closure member is mounted in a pouring position;

a first flange portion extending from the periphery of said closure member for providing fluid-tight engagement between the can and said closure member when said closure member is mounted in a non-pouring position on the can;

a second flange portion extending from the periphery of said closure member for providing fluid-tight engagement between the can and said closure member when said closure member is mounted in a pouring position on the can; and, a spout, projecting from the periphery of said closure and extending around only a part of the periphery of said closure, extending away from the can top when mounted in a pouring position and extending along the external side of the can when mounted in a non-pouring.

* * * * *